US005920940A

United States Patent [19]

Kauska et al.

[11] Patent Number: 5,920,940

[45] Date of Patent: Jul. 13, 1999

[54] GUN BARREL CLEANING TOOL

[76] Inventors: Robert Herman Kauska; Marlene K. Kauska, both of 306 Lincoln St., P.O. Box 29, Mancelona, Mich. 49659

[21] Appl. No.: 08/926,830

[22] Filed: Sep. 10, 1997

Related U.S. Application Data

[63] Continuation-in-part of application No. 08/628,332, Apr. 5, 1996., abandoned

[51] Int. Cl.[6] ..... F41A 29/02; A47L 25/00

[52] U.S. Cl. ..... 15/104.94; 15/104.93; 15/208; 15/210.1; 42/95

[58] Field of Search ..... 184/102; 42/95; 15/104.93, 104.94, 208, 209.1, 210.1, 104.165

[56] References Cited

U.S. PATENT DOCUMENTS 2,024,329 12/1935 Beesley ..... 184/102
3,205,518 9/1965 Romaine ..... 15/104.165
3,536,160 10/1970 Brewer ..... 184/102
4,547,924 10/1985 Brygider ..... 42/95

*Primary Examiner*—Randall E. Chin

[57] ABSTRACT

A gun barrel cleaning tool including an elongated planar rectangular plate having an upper surface, a lower surface, and a periphery extended therebetween; and an elongated cleaning pad coupled about the plate with the cleaning pad including an interior section formed of a sponge-like absorbent material having an upper interior surface positioned against the lower surface of the plate, a parabolic lower interior surface with a downwardly extending apex offset directly below the center of the plate, and a pair of opposed interior side surfaces therebetween, the cleaning pad further including a cover formed of an absorbent sheet of cloth material secured around the interior section, the cover having an upper exterior surface positioned upon the upper surface of the plate, a lower exterior surface positioned against the lower interior surface of the interior section, and a pair of opposed exterior side surfaces extended therebetween.

6 Claims, 5 Drawing Sheets

GUN BARREL CLEANING TOOL

RELATED APPLICATION

The present application is a continuation-in-part of application Ser. No. 08/628,332 filed Apr. 5, 1996, now abandoned.

BACKGROUND OF THE INVENTION

1. Field of the Invention

The present invention relates to a gun barrel cleaning tool and more particularly pertains to allowing a user to clean and lubricate an area between a vent rib and a barrel on a gun with a gun barrel cleaning tool.

2. Description of the Prior Art

The use of gun cleaning tools is known in the prior art. More specifically, gun cleaning tools heretofore devised and utilized for the purpose of cleaning guns are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,291,477 to Carlton discloses a gun barrel cleaning device. U.S. Pat. No. 4,716,673 to Williams et al. discloses a gun barrel cleaner and container therefore. U.S. Pat. No. 4,930,240 to Bice discloses a gun barrel cleaning device. U.S. Pat. No. 5,075,998 to Selleck discloses a gun cleaning rod with swivel handle. U.S. Pat. No. 5,171,925 to Mekler discloses a gun barrel cleaning tool.

While these devices fulfill their respective, particular objective and requirements, the aforementioned patents do not describe a gun barrel cleaning tool that allows a user to readily clean an area between a vent rib and barrel on a rifle, handgun, or other like ballistic weapon.

In this respect, the gun barrel cleaning tool according to the present invention substantially departs from the conventional concepts and designs of the prior art, and in doing so provides an apparatus primarily developed for the purpose of allowing a user to clean and lubricate an area between a vent rib and a barrel on a gun.

Therefore, it can be appreciated that there exists a continuing need for new and improved gun barrel cleaning tool which can be used for allowing a user to clean and lubricate an area between a vent rib and a barrel on a gun. In this regard, the present invention substantially fulfills this need.

SUMMARY OF THE INVENTION

In the view of the foregoing disadvantages inherent in the known types of gun cleaning tools now present in the prior art, the present invention provides an improved gun barrel cleaning tool. As such, the general purpose of the present invention, which will be described subsequently in greater detail, is to provide a new and improved gun barrel cleaning tool and method which has all the advantages of the prior art and none of the disadvantages.

To attain this, the present invention essentially comprises, in combination, an elongated rigid planar rectangular plate with rounded corners having an upper surface, a lower surface, a periphery perpendicularly interconnecting the surfaces and thereby defining a thickness and with the periphery formed of a pair of opposed long edges with a pair of short edges therebetween. The plate has width between about eleven to twelve times larger than the thickness. The plate has a length twelve times larger than the width. A pair of elongated spaced protrusions is located near the ends of the plate with each protrusion integral with and extended upwards from the upper surface and further extended crosswise between the long edges. Each pair of protrusions defines a grip for allowing a user a firm hold for cleaning.

An elongated cleaning pad is included and coupled about the plate between the grips. The cleaning pad has an interior section formed of a sponge-like absorbent material. The length of the interior section is about 19% less than the length of the plate. The interior section has a generally rectangular cross-section, a planar upper interior surface positioned against the lower surface of the plate, an elongated parabolic lower interior surface with a downwardly extending apex offset directly below the center of the plate, and a pair of opposed interior side surfaces interconnecting the upper interior surface with the lower interior surface. The cleaning pad includes a cover formed of an absorbent sheet of felt material secured around the interior section. The cover has an upper exterior surface positioned upon the upper surface of the plate, a lower exterior surface positioned against the lower interior surface of the interior section, and a pair of opposed exterior side surfaces extended therebetween in contact with the interior side surfaces of the interior section. The distance between a point on the lower exterior surface aligned with the apex of the interior section to a point on the upper exterior surface of the cover aligned with the center of the plate is about 18% greater than the width of the plate.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gun barrel cleaning tool which has all the advantages of the prior art gun cleaning tools and none of the disadvantages.

It is another object of the present invention to provide a new and improved gun barrel cleaning tool which may be easily and efficiently manufactured and marketed.

It is a further object of the present invention to provide a new and improved gun barrel cleaning tool which is of durable and reliable construction.

An even further object of the present invention is to provide a new and improved gun barrel cleaning tool which is susceptible of a low cost of manufacture with regard to both materials and labor, and which accordingly is then susceptible of low prices of sale to the consuming public, thereby making such a gun barrel cleaning tool economically available to the buying public.

Still yet another object of the present invention is to provide a new and improved gun barrel cleaning tool which provides in the apparatuses and methods of the prior art some of the advantages thereof, while simultaneously overcoming some of the disadvantages normally associated therewith.

Even still another object of the present invention is to provide a new and improved gun barrel cleaning tool comprising an elongated planar rectangular plate having an upper surface, a lower surface, and a periphery extended therebetween; and an elongated cleaning pad coupled about the plate, the cleaning pad including an interior section formed of a sponge-like absorbent material having an upper interior surface positioned against the lower surface of the plate, a parabolic lower interior surface with a downwardly extending apex offset directly below the center of the plate, and a pair of opposed interior side surfaces therebetween, the cleaning pad further including a cover formed of an absorbent sheet of cloth material secured around the interior section, the cover having an upper exterior surface positioned upon the upper surface of the plate, a lower exterior surface positioned against the lower interior surface of the interior section, and a pair of opposed exterior side surfaces extended therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
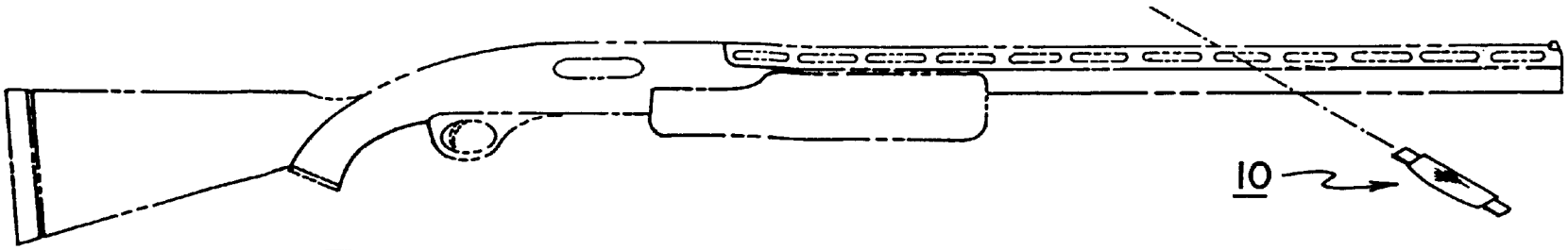
FIG. 1 is a perspective view of the preferred embodiment constructed in accordance with the principles of the present invention positioned in an orientation for cleaning an area between a vent rib and a barrel on a gun.

With reference now to the drawings, and in particular, to FIG. 1 thereof, the preferred embodiment of the new and improved gun barrel cleaning tool embodying the principles and concepts of the present invention and generally designated by the reference number 10 will be described.

The preferred embodiment of the present invention comprises a plurality of components. In their broadest context, such components include a plate and cleaning pad. Such components are individually configured and correlated with respect to each other to provide the intended function of cleaning and lubricating an area between a vent rib and a barrel on a gun.

Specifically, the present invention includes an elongated plate 12. The plate is planar and rectangular in structure. It is formed of a rigid metal material. It can also be formed of plastic. The plate has rounded corners 14 to preclude a barrel of a gun from being scratched when the present invention is put in use. The plate has an upper surface 16, a lower surface 18 and a periphery 20 perpendicularly interconnecting the surfaces. The periphery thereby defines a thickness between the upper surface and lower surface. The periphery is formed of a pair of opposed long edges 22 with a pair of short edges 24 extended therebetween. The plate has a width defined between the long edges. This width is about 11–12 times larger than the thickness of the plate. The plate also has a length defined between the short edges. The length is about 12 times larger than the width of the plate. The plate also includes a pair of elongated spaced protrusions 26. The protrusions are located near the ends of the plate. Each protrusion is integral with and extended upwards from the upper surface of the plate. Each protrusion is further extended crosswise between the long edges. Each protrusion has a generally crescent-shaped cross section. Each pair of protrusions on each end of the plate defines a grip 28 for allowing a user a firm hold for cleaning an area between a vent rib and the barrel on a gun.

Figure 2:
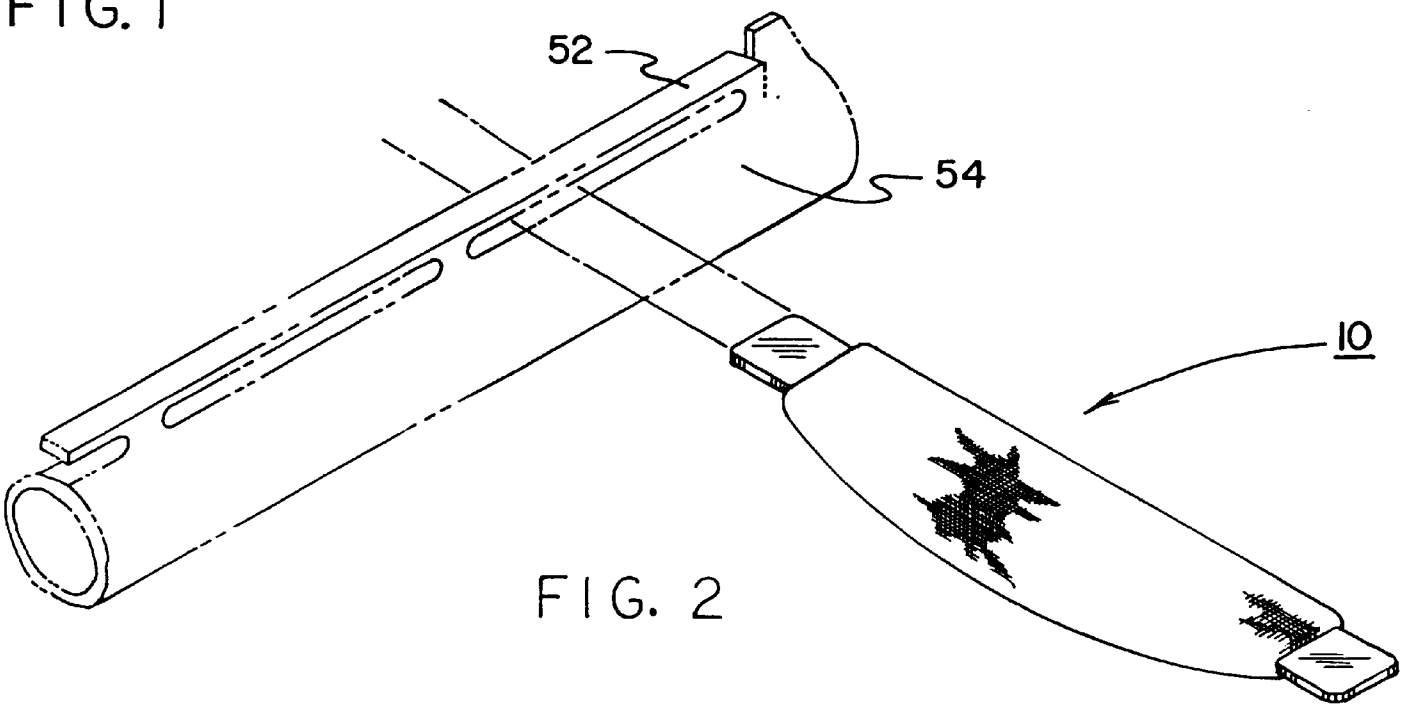
FIG. 2 is an enlarged perspective view of the present invention.
Figure 3:
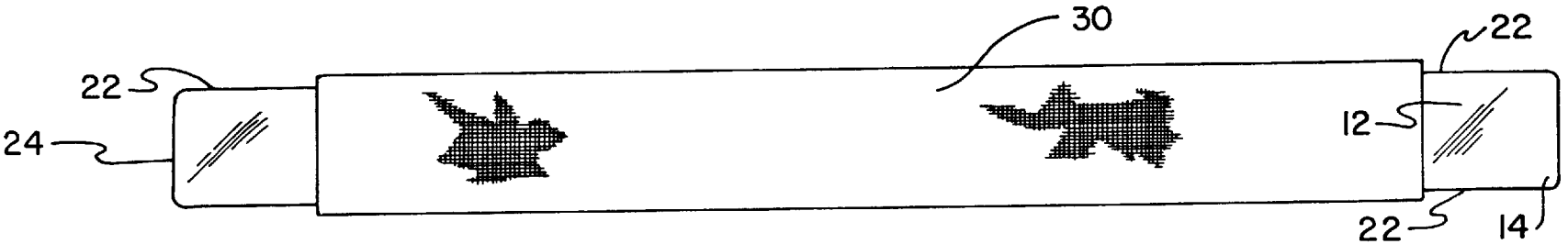
FIG. 3 is a plan view of the present invention as previously shown in FIG. 2.
Figure 4:
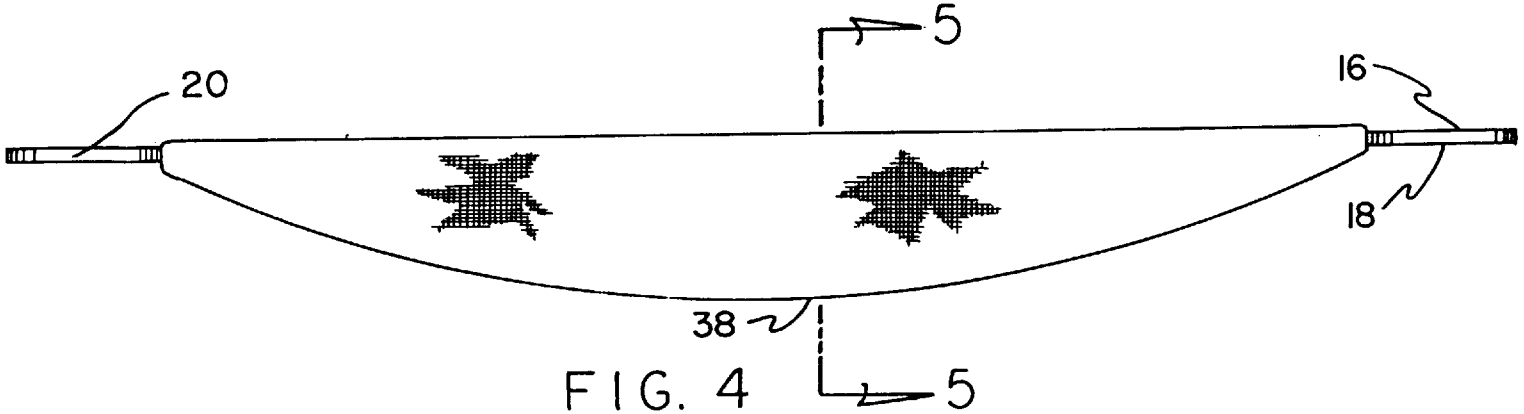
FIG. 4 is a side elevational view of the present invention.
Figure 5:
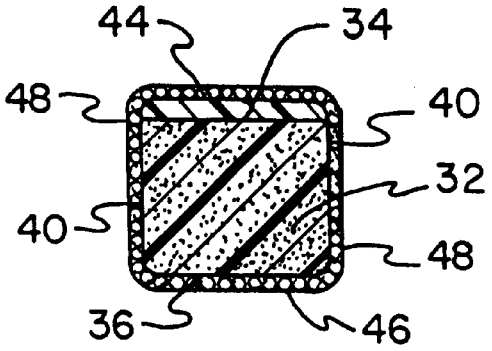
FIG. 5 is a cross-sectional view of the present invention taken along the line 5—5 of FIG. 4.
Figure 6:
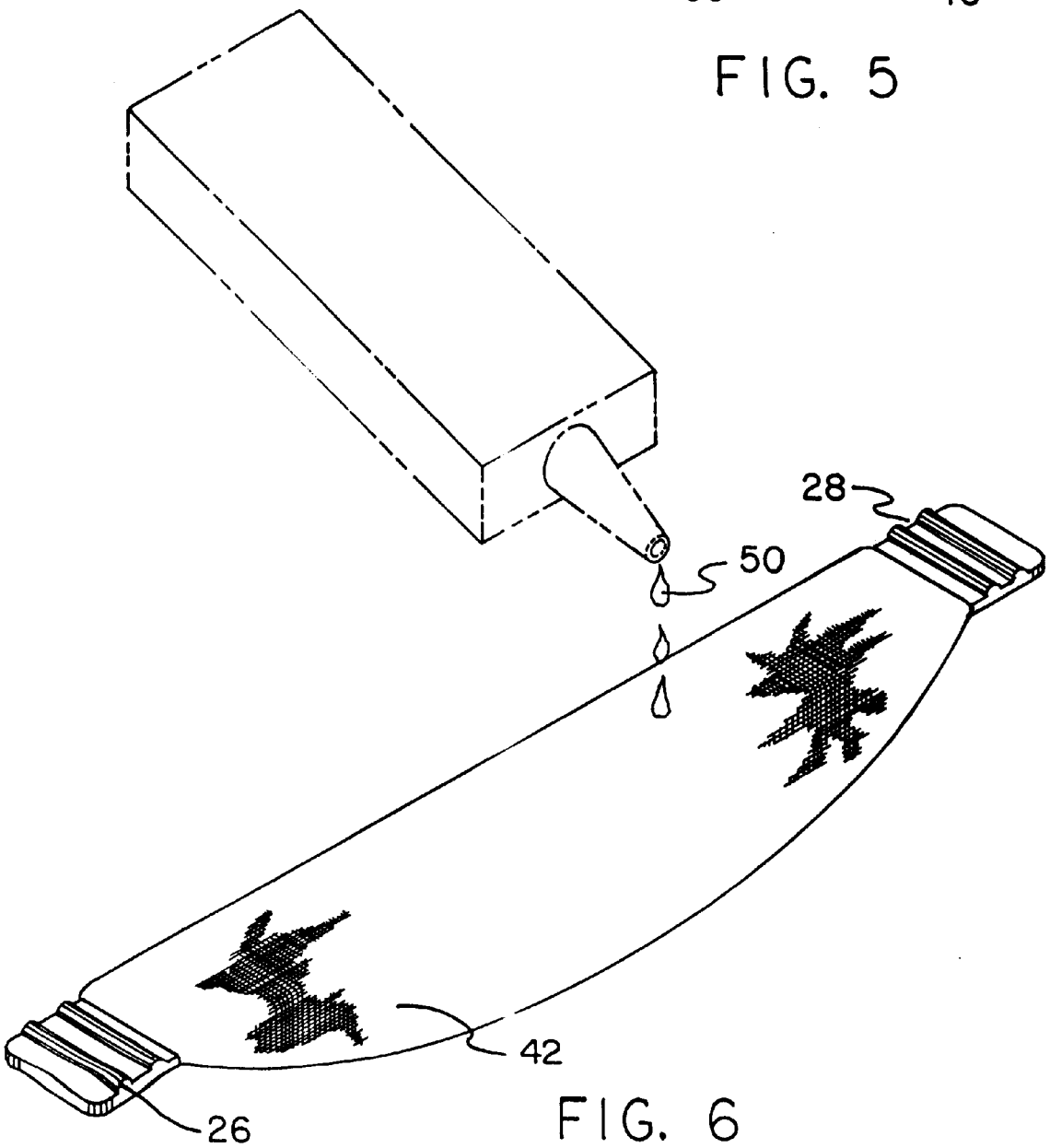
FIG. 6 is a perspective view of the present invention with gun cleaning fluid being disposed thereon.

Also provided is an elongated cleaning pad 30. The cleaning pad is coupled about the plate at a location between its grips. The cleaning pad includes an interior section 32. The interior section is formed of a sponge-like absorbent material. This material has a characteristic such that it can retain cleaning oil or other such lubricant therein. The interior section of the cleaning pad has a length about 19% less than the length of the plate. The interior section also has a generally rectangular cross-section. The interior section includes a planar upper interior surface 34 positioned against the lower surface 18 of the plate. The upper interior surface may also be rigidly adhered to the lower surface of the plate with a layer of adhesive. The interior section includes an elongated parabolic lower interior surface 36 with a downwardly extending apex 38. The apex is directly offset below the center of the plate. A pair of opposed interior side surfaces 40 interconnect the upper interior surface with the lower interior surface of the interior section. The cleaning pad also includes a cover 42. The cover is formed of an absorbent sheet of felt material. This sheet has a characteristic that enables it retain cleaning fluid therein for use when cleaning. The cover is secured around the interior section. This type of securement is formed by first stitching the sheet in a sock-like configuration and then disposing it over a squeezed and collapsed interior section. The cover has an upper exterior surface 44 positioned upon the upper surface of the plate. The cover has a lower exterior surface 46 positioned against the lower interior surface 36 of the interior section. Lastly, a pair of opposed exterior side surfaces 48 extend between the upper exterior surface and lower exterior surface. These side surfaces are positioned in contact with the interior side surfaces 40 of the interior section. Thus, the cover secures the interior section in a proximal position against the lower surface of the plate. When secured in this fashion, the distance between the point on the lower exterior surface aligned with the apex 38 of the interior section to a point on the upper exterior surface of the cover aligned with the center of the plate is about 18% greater than the width of the plate. In this configuration, cleaning fluid 50 may be disposed upon the cover and absorbed within the interior section. When disposed within a slot defined by the vent rib 52 and gun barrel 54 as shown in FIG. 2, the interior section collapses thereby releasing the cleaning fluid within the area for cleaning. Frictional contact of the cover against the barrel and the vent rib thus provides an actuating force for dislodging sediment and the like. After cleaning has been performed, the interior section and cover of the cleaning pad may be rung out to remove the remaining cleaning fluid resident therein. The cover may also be replaced when it becomes worn.

In the preferred embodiment, the thickness of the plate is about 2 millimeters. The width of the plate as measured perpendicularly between the long edges is about 22 millimeters. The length of the plate as measured perpendicularly between the short edges thereof is about 310 millimeters. The length of the cleaning pad is about 250 millimeters. The perpendicular distance between the upper surface of the cover to the lower surface of the cover at the central apex is about 28 millimeters.

The present invention is an implement expressly designed for use on guns. The present invention assists in cleaning lubricating and protecting the area at the intersection of the vent rim and barrel of the gun. The present invention is specially contoured to accommodate the aforementioned area, and it is covered with felt. When viewed from the top, this handy tool appears to be an elongated rectangle. When viewed from the side, this form is that of a long and low profile crescent.

The present invention is designed to perform three distinct chores. First, it is ideal for simply cleaning the area between the vent bin barrel on a rifle, handgun, or the like. Secondly, its felt covering is absorbent, and it can first be soaked in a gun cleaning solution to make cleaning easier and more effective. Finally, this absorbency facilitates soaking up felt with water-repellant silicone, and the area between a vent rib and barrel on a gun can be protected from the accumulation of water and ultimate formation of corrosion.

Figure 7:
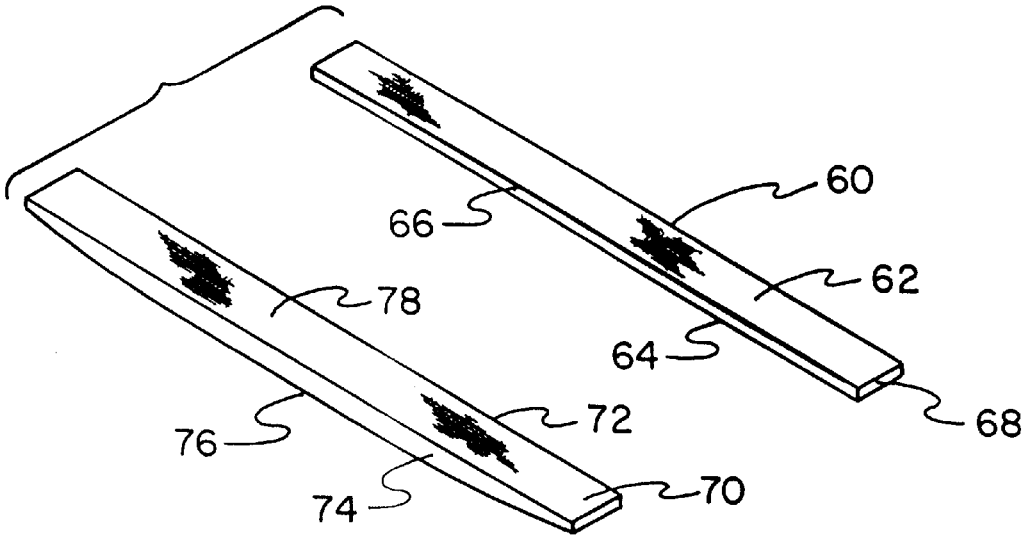
FIG. 7 is a perspective view of an alternate embodiment of the present invention.
Figure 8:
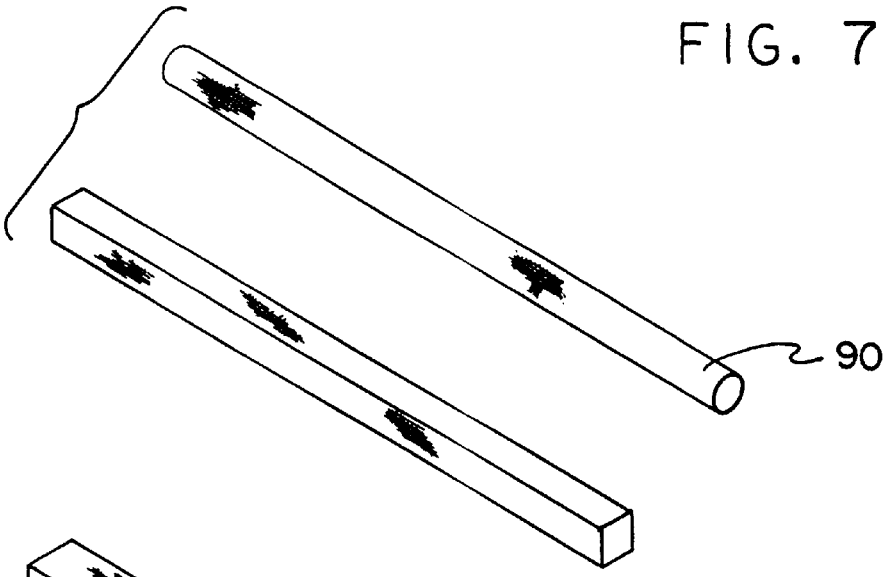
FIG. 8 is a perspective view of another alternate embodiment of the present invention.
Figure 9:
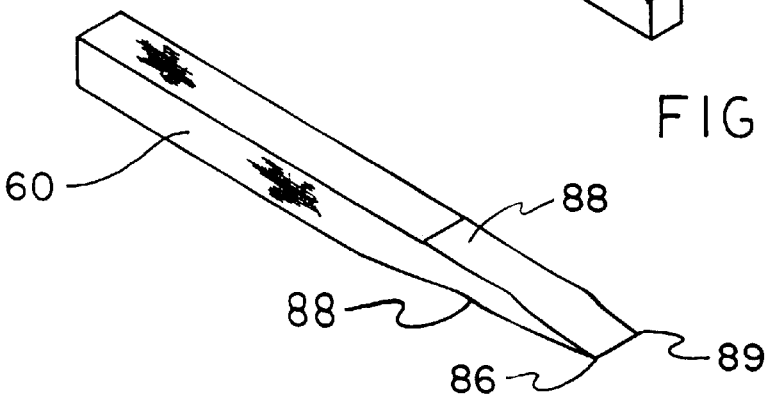
FIG. 9 is a perspective view of yet another alternate embodiment of the present invention.
Figures 10, 11:
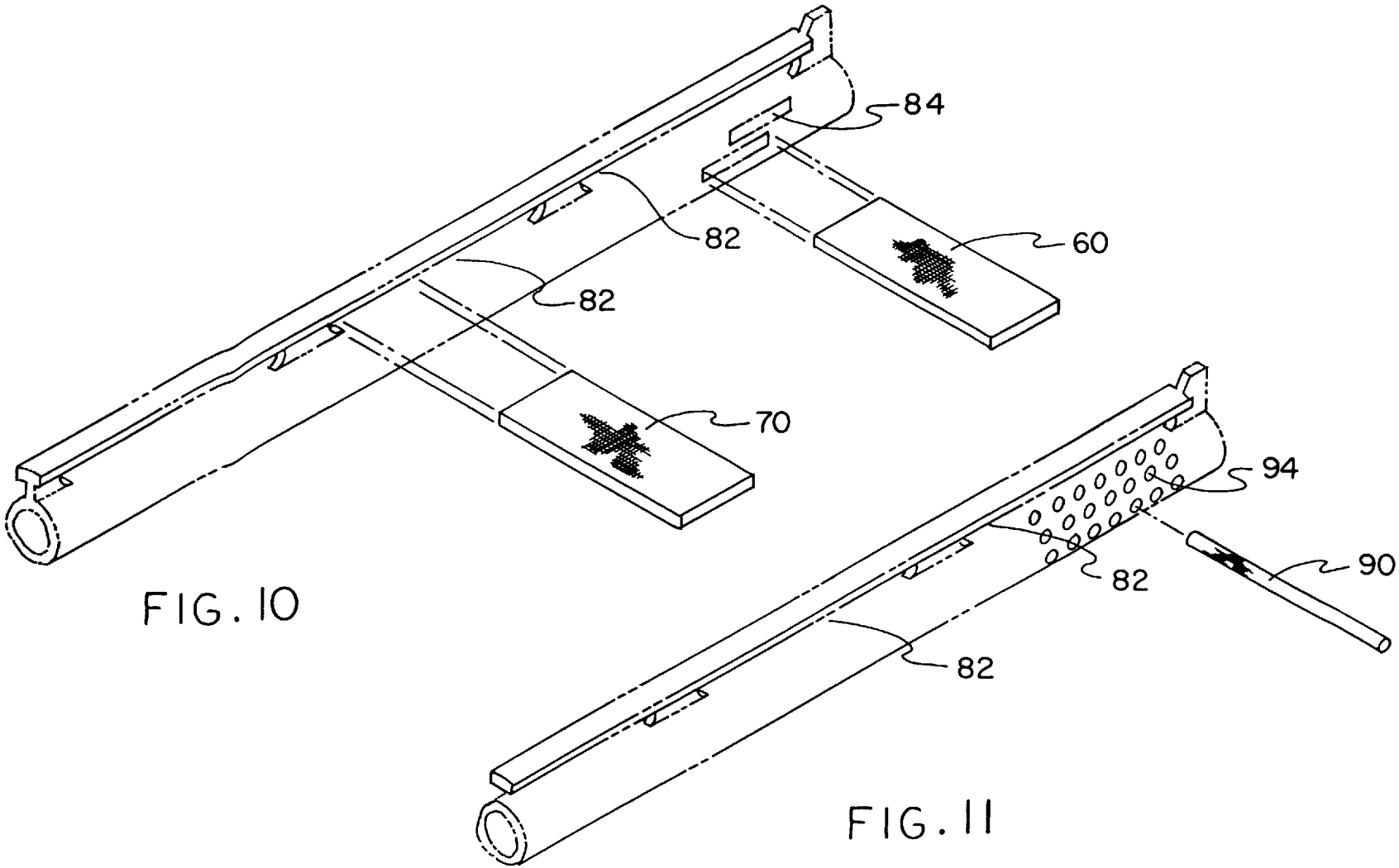
FIG. 10 is a perspective view of the alternate embodiment of FIG. 7 in use for cleaning vent rib apertures and vent ports on one type of gun barrel.
FIG. 11 is a perspective view of the alternate embodiment of FIG. 8 in use for cleaning vent rib apertures and vent ports on another type of gun barrel.

Alternate embodiments of the present invention are depicted in FIGS. 7–9. Each of these embodiments is formed of a strip of felt or other suitable fabric material and is used for cleaning parts of a gun barrel. As shown in FIG. 7, strip 60 is elongated and box-shaped in structure and has a planar top surface 62, a planar bottom surface 64 positioned in parallel alignment with the top surface, and a periphery perpendicularly interconnecting the surfaces formed of a pair of opposed planar long edges 66 and a pair of opposed planar short edges 68. Another variation is strip 70 which has a planar top surface 72, a parabolic bottom surface 74 projected downwards with respect to the top surface and terminated at an apex 76 that is positioned in alignment with the midpoint of the strip, and a periphery perpendicularly interconnecting the surfaces formed of a pair of opposed planar long edges 78 and a pair of opposed planar short edges 80. Strip 60 and 70 have a length of between about 2 to 4 inches, a thickness of between about 0.7 to 1.25 inches, and width of about ¼ inch. For strip 70, the width is measured perpendicularly from the apex 76 to the top surface. These sizes allow the strips 60, 70 to clean the vent rib apertures 82 or the generally rectangular shaped vent ports 84 on a barrel as shown in FIG. 10. Preferably, the thickness of each of the strips 60, 70 is 0.7 inches, and the length of each of the strips is between about 2 to 3 inches. In addition, a bevel 86 can be formed on strip 60 as shown in FIG. 9 to allow cleaning of hard-to-reach crevices on the barrel. Bevel 86 is formed on an end of the strip to thereby create a pair of opposed planar angled edges 88 extended between the top surface and bottom surface and define a point 89. Preferably, the angle formed between edges 88 as measured with respect to the point can be between about 10 to 90 degrees.

Yet another variation of the felt cleaning strip is shown in FIG. 8. The strip 90 has a cylindrical shape with a diameter of between about 0.9 to 1 inch and a length of about 2 inches. Still yet another strip 92 can also be formed to have a square cross section with a width of about 0.9 to 1 inch and a length of about 2 inches. These sizes allow the strips 90, 92 to clean the vent rib apertures 82 and the generally circular-shaped vent ports 94 on a barrel as shown in FIG. 11. The positioning and shape of vent ports 84, 94 are used to reduce recoil and barrel jump when the gun is fired and are available as an integral part of several commercially available guns.

The most preferred sizes and materials for the embodiments of FIGS. 7 through 9 will now be described. The preferred material is felt. The preferred felt, as shown in such Figures, is a cloth made of wool and fur often mixed with natural or synthetic fibers through the action of heat, moisture, chemicals, and pressure. The major material is preferably wool fibers of felt, not woven or knitted. The preferred length of the five felt devices shown in FIGS. 7 through 9 are 4.0 inches but could be from between about 3.5 inches and 4.5 inches. The same length is for all embodiments of FIGS. 7 through 9. The thickness is preferably 1/8 inches, or from between about 1/16 and ⅜ inches. The width of the embodiment of FIG. 7 is preferably about ⅜ inches, or from between about ¼ and ½ inches. The tapered embodiment of FIG. 7 tapers at the center with a maximum thickness of about ¼ inches, or between about ⅛ and ⅜ inches.

With regard to the FIG. 8 embodiment, the circular embodiment has a diameter of about ¼ inches, or between about ⅛ and ⅜ inches. The square embodiment has a height and width of about ¼ inches, or between about ⅛ and ⅜ inches.

The rectangular embodiment of FIG. 9 with a tapered end has a width and thickness of about ⅛ inches, or between about ¼ and ½ inches. Such cross-section is square over the majority of its extent. There is a taper at one end. The taper constitutes a minor percent of the total length of the device. In this embodiment, the taper comes to a line at the tapered end.

As can be understood from the above-described dimensions, the minimum thickness in its least dimension (1/16 inch) throughout the majority of its length to its overall length (4.5 inches) has a ratio not greater than 1:72. Conversely, the maximum width in its greatest dimension (½ inch) to its overall length (3.5 inches) has a ratio not less than 1:7.

In operation, the embodiments of FIGS. 7 through 9 could be used when the device is clean, not soaked with a fluid. The device also could be soaked in a fluid such as any conventional gun cleaner oil, as for example, Hoppys No. 9 ECT or silicone or other conventional lubricants. In applying such lubricant, the lubricant is preferably poured principally in the central extent of the device for maximum lubrication. In this manner, the ends would be lubricated to a limited degree having been wetted through capillary action of the liquid flowing through the device but would have less lubricant at its ends to allow better gripping by a user.

The present invention is shaped to suit its intended purpose and it is readily manipulated. The present invention is small and portable and can be easily carried in a pocket or backpack. As such, the present invention can be used either at home or when in the field. Gun cleaning tool improvisations, such as the use of a sharply pointed and cloth-covered tool for removing dirt and sediment within an area between a vent rib and barrel of a gun will not longer be necessary, and the finish of an expensive gun will therefore be protected and preserved. The embodiments of FIG. 8 are preferably used for pro-porting as shown in FIG. 11. The other embodiments are preferably used for magna-porting as shown in FIG. 10. In addition, the showing of FIGS. 10 and 11 illustrate the devices as being of a generally rigid nature allowing the devices to be held at one end and pushed through areas to be cleaned without the unheld end drooping or sagging even when soaked with a cleaning fluid.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A gun barrel tool comprising:

a strip of felt having a length of between about 3.5 and 4.5 inches, with a minimum thickness to length ratio not greater than 1:72 and a maximum width to length ratio not less than 1:7;

wherein the strip has at least one tapering end.

2. The tool as set forth in claim 1 wherein the cross section of the strip is rectangular.

3. The tool as set forth in claim 1 wherein the cross section of the strip is square.

4. The tool as set forth in claim 1 and further including a lubricant in strip.

5. The tool as set forth in claim 1, wherein the strip is generally rigid allowing the strip to be held at one end and pushed through areas to be cleaned without the unheld end drooping.

6. A tool for cleaning and lubricating vent rib apertures and vent ports on a gun comprising:

a strip of felt having a common cross-sectional configuration along the majority of its length with a length of between 3.5 and 4.5 inches and a thickness of between 1/16 and ⅜ inches, the strip having a first end for insertion into a vent rib aperture and a vent port, the first end having a taper, the strip also having a second end for grasping thereadjacent during insertion.

* * * * *